US006082163A

United States Patent [19]

Hara

[11] Patent Number: 6,082,163

[45] Date of Patent: Jul. 4, 2000

[54] MULTIPLE SLIP TYPE WET-DRAWING PROCESS

[75] Inventor: Hisakatsu Hara, Kuroiso, Japan

[73] Assignee: Bridgestone Corporation, Tokyo, Japan

[21] Appl. No.: 09/246,123

[22] Filed: Feb. 8, 1999

[30] Foreign Application Priority Data

Feb. 24, 1998 [JP] Japan ..... 10-041834

[51] Int. Cl.[7] ..... B21C 1/06

[52] U.S. Cl. ..... 72/280; 72/289

[58] Field of Search ..... 72/289, 280

[56] References Cited

U.S. PATENT DOCUMENTS

| | | | |
|---|---|---|---|
| 3,765,215 | 10/1973 | Martin | 72/280 |
| 3,953,998 | 5/1976 | Braun | 72/289 |
| 4,280,857 | 7/1981 | Dameron | 72/286 |
| 5,301,119 | 4/1994 | Watkins | 72/280 |

FOREIGN PATENT DOCUMENTS

| | | |
|---|---|---|
| 9-24413 | 1/1997 | Japan . |
| 2614950 | 2/1997 | Japan . |
| 9-99312 | 4/1997 | Japan . |

*Primary Examiner*—Daniel C. Crane
*Attorney, Agent, or Firm*—Sughrue, Mion, Zinn, Macpeak & Seas, PLLC

[57] ABSTRACT

In a multiple slip type wet-drawing process using plural drawing pass stages each comprised of a die and a capstan drawing a wire rod passed through the die, an average slip rate in each drawing pass stage other than a final stage is set to a range of 5~80 m/min, whereby the wire drawing is carried out without causing problems such as damage of wire rod surface, wire breakage, premature wearing of die and the like.

4 Claims, 4 Drawing Sheets

MULTIPLE SLIP TYPE WET-DRAWING PROCESS

BACKGROUND OF THE INVENTION

1. Field of the Invention

This invention relates to a process for wet-drawing a wire rod through a multiple slip type wet-drawing machine.

2. Description of Related Art

The multiple slip type wet-drawing process manufactures a wire filament having a desired diameter by continuously and successively drawing a wire rod through a drawing apparatus provided with plural drawing pass stages each comprised of a die and a capstan giving a drawing force to the wire rod passed through the die to reduce a diameter of the wire rod, and lies in that the die and the capstan in at least a part of the stages are immersed in a lubricating solution to provide a velocity difference between the capstan and the drawn wire rod.

As compared with a non-slip type dry-drawing process using a dry lubricant wherein a peripheral velocity of the capstan is the same as a drawing velocity of the wire rod, the multiple slip type wet-drawing process has various merits that the drawing apparatus may be simple and compact, and a wire filament having a good surface smoothness can be manufactured and the like, and is particularly and widely used in the manufacture of wire filaments such as steel filament for steel cord and the like. Since there is the velocity difference between the capstan and the drawn wire rod, however, it is apt to cause problems such as damage of the wire rod surface, wire breakage due to the change of drawing speed and tension, premature wearing of the die and the like, so that it is important to set not only a reduction of area in the die but also the difference between the peripheral velocity of the capstan and the drawing velocity of the wire rod to a certain level, respectively.

For example, Japanese Patent No. 2614950 discloses a multiple slip type wet-drawing process wherein a working ratio of the die is set within a particular range and when a slip ratio $S_1$ is defined by $S_1=(1-v_1/V_1)\times 100\%$ wherein $v_1$ is a drawing velocity of a wire rod passed through a first die and $V_1$ is a peripheral velocity of a capstan drawing such a wire rod, $S_1$ is not more than 30%.

And also, JP-A-9-24413 discloses a multiple slip type wet-drawing process wherein when $Vc_0=Vw_0$ in which $Vc_0$ is a peripheral velocity of a final capstan and $Vw_0$ is a passing velocity of a metal filament through a final die, a slip rate ratio Sn is defined by $Sn=\{(Vc_n-Vw_n)/Vc_0\}\times 100\%$ in which $Vw_n$ is a passing velocity of a metal filament through an arbitrary die and $Vc_n$ is a peripheral velocity of a capstan drawing such a filament and is 3%~8%.

However, there is frequently caused a case that the problems such as damage of wire rod surface, wire breakage due to the change of drawing velocity and tension, premature wearing of die and the like are not solved even by adopting the aforementioned techniques. Particularly, such a technique remarkably comes into problem in case of increasing the drawing velocity or manufacturing high-strength steel filaments.

As a method of setting a reduction of area in the die in the manufacture of the high-strength steel filaments, for example, JP-A-9-99312 discloses a drawing method wherein when a wire drawing strain $\epsilon$ is defined by $\epsilon=21n(d_0/d)$ (wherein $d_0$: diameter of starting wire rod, d: diameter of a rod in each stage of the drawing step, and ln: natural logarithm) in order to provide high-strength steel filaments having a good turning property, the reduction of area in the die is 10~20% at ① a stage of $0.3\geqq\epsilon\geqq 0$, 15~25% at ② a stage of $0.3<\epsilon<3.0$, and 2~15% at ③ a stage of $3.0\geqq\epsilon$.

In JP-A-7-305285 is disclosed a drawing method wherein when the wire drawing is carried out so as to have a wire drawing strain $\epsilon$ of not less than 4.0 at a final die in order to provide high-strength steel filaments having a good ductility, ① the reduction of area in the die used in the wire drawing at $\epsilon$ of less than 0.75 is $(22.67\epsilon+3)\%$~29%, and ② the reduction of area in the die used in the wire drawing at $\epsilon$ of 0.75~2.25 is 20~29%, and ③ the reduction of area in the die used in the wire drawing at $\epsilon$ of more than 2.25 is $(-6.22\epsilon+43)$~$(-5.56\epsilon+32.5)\%$.

Even when the above reduction of area in the die is applied to the multiple slip type wet-drawing process, however, if the setting of the velocity difference between the capstan and the drawn wire rod is inadequate, there are caused problems such as surface damage of steel filament, wire breakage, premature wearing of the die and the like, and the turning property, ductility and the like are not so improved.

SUMMARY OF THE INVENTION

It is, therefore, an object of the invention to solve the aforementioned problems of the conventional techniques and to provide a multiple slip type wet-drawing process for realizing the drawing by properly setting the velocity difference between the capstan and the drawn wire rod without causing the problems such as damage of wire rod surface, wire breakage, premature wearing of the die and the like even if the drawing velocity is increased.

It is another object of the invention to provide a drawing process capable of particularly applying to high-speed drawing of high-strength wire filaments by properly setting the reduction of area in the die.

According to the invention, there is the provision of in a multiple slip type wet-drawing process using plural drawing pass stages each comprised of a die and a capstan drawing a wire rod passed through the die, an improvement wherein an average slip rate $S_i$ in each drawing pass stage other than a final stage defined by the following equation:

$$S_i=Vc_i-Vw_i$$

wherein $Vc_i$ is a peripheral velocity of a capstan at each stage and $Vw_i$ is an average velocity of a wire rod passed through a die at each stage, is set to a range of 5~80 m/min.

In a preferable embodiment of the invention, wire drawing corresponding to not less than 40% of total wire drawing strain is carried out by using a die having a reduction of area of not less than 20%.

In another preferable embodiment of the invention, wire drawing using the die having the reduction of area of not less than 20% is carried out in a drawing pass drawing a wire rod having a cumulative drawing strain from an initial stage of not less than 0.5 but less than 2.5.

BRIEF DESCRIPTION OF THE DRAWINGS

The invention will be described with reference to the accompanying drawings, wherein.

DESCRIPTION OF PREFERRED EMBODIMENTS

Figure 1:
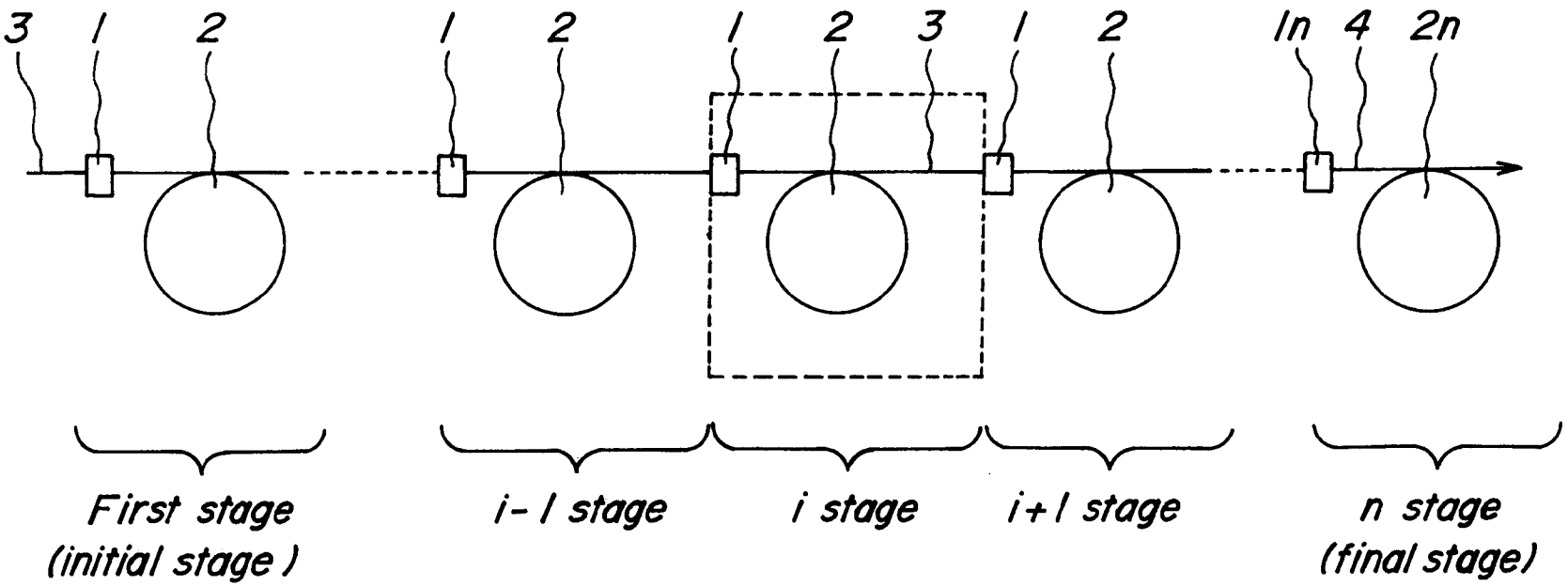
FIG. 1 is a diagrammatic view illustrating a multiple slip type wet-drawing apparatus.

As shown in FIG. 1, the multiple slip type wet-drawing apparatus according to the invention comprises a plurality of drawing passes each comprised of a die 1 and a capstan 2 arranged at a delivery side thereof. A wire rod 3 introduced into such an apparatus is subjected to wire drawing at each drawing pass stage by winding the wire rod passed through the die 1 around the capstan 2 and rotating the capstan 2 to produce a drawing force from the die 1. In this case, a wire filament reduced to a desired diameter is obtained by repeating such a drawing pass through plural stages up to a final n-stage.

In the invention, when an average slip rate $S_i$ at each drawing pass stage other than a final drawing pass stage, e.g. at i-stage of the drawing pass is defined by an equation of $S_i=Vc_i-Vw_i$ wherein a hole diameter of a die 1 at the i-stage and a diameter of a wire rod 3 drawn from the die 1 at the i-stage are $D_i$, an average velocity of the wire rod 3 drawn from the die 1 at the i-stage is $Vw_i$, and a peripheral velocity of a capstan 2 at the i-stage is $Vc_i$, it is important that $S_i$ is set to a range of 5~80 m/min. In a transition period from a stop state to a given steady drawing velocity, both $Vc_i$ and $Vw_i$ change and hence the average slip rate $S_i$ changes. In the invention, therefore, the average slip rate $S_i$ in at least a steady drawing velocity is set to 5~80 m/min.

Moreover, the average velocity $Vw_i$ of the wire rod passed through the die 1 at the i-stage is calculated according to an equation of $Vw_i=Vw_n\times(D_i/D_n)^2$, wherein $Vw_n$ is an average velocity of a wire filament 4 drawn from a final die 1*n* at a final n-stage and $D_n$ is a diameter of the wire filament 4 drawn from the final die 1*n*.

In the conventional multiple slip wet-drawing process, the setting of slip condition has been carried out by noticing a ratio of slip rate to capstan peripheral velocity. On the contrary, the drawing process according to the invention is characterized by setting the value of the average slip rate itself in each drawing pass stage other than the final stage to a range of 5~80 m/min. This is based on the following knowledge.

In general, the final stage in the multiple slip type wet-drawing process is substantially $Vw_n=Vc_n$, but the operation in each stage other than the final stage is carried out at $Vc_i>Vw_i$ because the wire rod is drawn out by the capstan. And also, it is common that the peripheral velocity of the capstan in each stage at the steady drawing velocity is constant. However, the wire velocity at a stage of $Vc_i>Vw_i$ is not necessarily constant, so that it can change up and down from $Vw_i$ as an average in time.

For example, assuming that the velocity of the wire rod (hereinafter referred to as a wire velocity) at the i-stage is larger than $Vw_i$, such a state may be created because of $Vc_i>Vw_i$. As a result, tension of the wire rod at an upstream-side i−1 stage rises and the contact pressure between the capstan and the wire rod increases to bring about the increase the wire velocity. And also, the propagation of such a phenomenon to a further upstream-side stage may be caused. Therefore, the wire breakage is caused if the increase of the wire velocity at a stage located at the upstream side of a certain stage can not follow to the increase of the wire velocity at such a certain stage. On the other hand, tension behind a die at a downstream-side i+1 stage (tension of the wire rod input to the i+1 stage) decreases and hence rise of die surface pressure, decrease of drawing force and the like are caused, which may also be propagated to a further downstream-side stage. The state that the wire velocity at the i-stage is larger than $Vw_i$ is not held at a steady state. That is, the quantity of the wire rod drawn from the i−1 stage to the i-stage is larger than that drawn from the i-stage to the i+1 stage so that tension behind the capstan at the i-stage decreases and hence there is caused a state that the wire velocity at the i-stage becomes inversely smaller than the average wire velocity $Vw_i$.

The above change of the wire velocity results in the degradation of the tire rod to be drawn, occurrence of wire breakage, premature wearing of the die or the like. Therefore, it is desirable that the multiple slip type drawing is carried out at a state that the wire velocity at each stage is not changed as far as possible or a state that the difference between the wire velocity and the capstan peripheral velocity is not changed as far as possible.

The inventors have made various studies with respect to a relation between setting condition of average wire velocity $Vw_i$ to the capstan peripheral velocity $Vc_i$ and changing quantity of wire velocity and found that the multiple slip type wet-drawing can be carried out at a stable state that the change of the wire velocity is less by setting an absolute value $S_i$ ($S_i=Vc_i-Vw_i$) of average slip rate at each stage other than final stage to a range of 5~80 m/min.

That is, when $S_i$ exceeds 80 m/min, the action of the capstan increasing the wire velocity becomes large and hence the wire velocity becomes unstable. Even if the wire velocity is stabilized at a value near to the average wire velocity $Vw_i$, the difference to the capstan peripheral velocity is still large, so that there are incidentally caused problems such as damage of wire rod surface, increase of consumption energy and the like. On the contrary, when $S_i$ is set to not more than 80 m/min, the change of the wire velocity is less and the drawing is carried out at a stable state. Particularly, $S_i$ of not more than 50 m/min is preferable, which can obtain good results with respect to the surface state of the wire rod and consumption energy.

As to the lower limit of $S_i$, it is theoretically considered that the drawing is carried out by setting $S_i$ at each stage to zero in such a manner that the wire velocity is always equal to the capstan peripheral velocity likewise the non-slip type drawing, but it is actually very difficult to always maintain $S_i$ at each stage at zero state due to the scattering of hole diameter in the die and the wearing of the die. Therefore, the operation at each stage other than the final stage is carried out at $Vc_i>Vw_i$ or $S_i>0$. In this case, when the value of $S_i$ is set to less than 5 m/min, the changing width of the wire velocity may be made small, but since the difference between the capstan peripheral velocity and the wire velocity is small, there may be caused the drawing sate through slip friction at $S_i>0$ and the drawing state through static friction at $S_i=0$. As a result, the friction coefficient between the capstan and the wire rod largely changes between slip friction coefficient and the static friction coefficient to increase the change of tension at the delivery side of the capstan and hence the tension behind the die at subsequent stage largely changes to bring about the wearing of the die, degradation of the wire rod quality and the like. Such a tension change may be propagated to a further upstream-side stage. In order to prevent the above phenomenon, it is effective to always draw out the wire rod through the slip friction and it is necessary to set the value of $S_i$ at each stage other than the final stage to not less than 5 m/min.

The action of the capstan increasing the wire velocity when being set to $S_i>0$ becomes larger as the turning number of the wire rod around the capstan increases. Therefore, In order to make small the change of the wire velocity, it is desirable that the turning number of the wire rod around the capstan is decreased as far as possible within a range capable of drawing out the wire rod from the die. In order to prevent the occurrence of wire breakage due to excessive drawing force, however, it is desirable that the reduction of area in the die and the turning number of the wire rod around the capstan at each stage are set so as to render a ratio ($Z_i/T_i$) of drawing force $Z_i$ at each stage inclusive of the final stage to tensile strength $T_i$ of the wire rod after the passage through the die (i=1~n) into not more than 60%.

Next, the invention will be described with respect to the setting of reduction of area in die in the drawing process. In this case, some terms are defined as follows.

(1) The term "die working strain $\epsilon_D$" is a wire drawing strain at one drawing pass stage. That is, when a diameter of a wire rod drawn at a pass of i−1 stage is $D_{i-1}$ and a diameter of a wire rod drawn at a pass of i-stage is $D_i$, $\epsilon_D$ in the drawing pass of the i-stage is $\epsilon_D=2\times 1n(D_{i-1}/D_i)$.

(2) The term "cumulative drawing strain $\epsilon_C$" is a wire drawing strain of a wire rod drawn out at a certain drawing pass. That is, when a diameter of a wire rod before the drawing in a drawing pass of an initial stage is $D_0$ and a diameter of a wire rod drawn out in a drawing pass of i-stage is $D_i$, $\epsilon_C$ of the wire rod passed through the i-stage is $2\times 1n(D_0/D_i)$ and corresponds to a total value of die working strains $\epsilon_D$ in the drawing passes before the i-stage.

(3) The term "total drawing strain $\epsilon T$" is a wire drawing strain of a wire filament drawn out in a drawing pass of a final stage. That is, when a diameter of a wire rod before the drawing in a drawing pass of an initial stage is $D_0$ and a diameter of a wire filament drawn out in a drawing pass of a final stage is $D_n$, the total drawing strain $\epsilon_T$ is $\epsilon_T=2\times 1n(D_0/D_n)$ and corresponds to a total value of $\epsilon_D$ in all drawing passes.

When the average slip rate $S_i$ is set to an acceptable range of the invention and the wire drawing corresponding to not less than 40% of the total drawing strain is carried out in a die setting a reduction of area to not less than 20%, high-strength steel filaments having an excellent ductility can more advantageously be manufactured without causing the problems such as damage of steel wire surface, wire breakage, premature wearing of die and the like. Concretely, a pass schedule is designed so as to render a total value of die working strain $\epsilon_D$ in dies setting the reduction of area to not less than 20% into not less than 40% of the total drawing strain $\epsilon_T$.

The above setting of the pass schedule is to largely control the concentric accumulation of working strain in a surface layer portion of the wire rod when the working ratio in the die setting the reduction of area to not less than 20% is rendered into not less than 40% as compared with the case of rendering the ratio into less than 40%. Particularly, such a setting is suitable for high-strength steel filaments as a reinforcement for a rubber article and the like and can provide high-strength steel filaments being less in the decrease of the ductility due to the heating accompanied with the vulcanization of rubber and having a high durability.

In the setting of the pass schedule satisfying the above condition, it is preferable that the wire drawing in the die setting the reduction of area to not less than 20% is carried out in a drawing pass that the wire drawing at a high reduction of area is relatively easy, or in a drawing pass of drawing a wire rod having a cumulative drawing strain $\epsilon_C$ of not less than 0.5 but less than 2.5. Because, the wire rod having $\epsilon_C$ of less than 0.5 is not yet good in the surface lubricity and it is difficult to conduct the wire drawing at a higher reduction of area in an upstream-side drawing pass having a smaller $\epsilon_C$. Particularly, this problem becomes remarkable in the drawing of brass-plated steel wire rod for the manufacture of the high-strength steel filament as a reinforcement for the rubber article. On the other hand, when the wire rod having $\epsilon_C$ of not less than 2.5 is worked in a drawing pass, the drawing velocity becomes faster and also the deformation resistance of the wire rod becomes higher, so that it is difficult to conduct the wire drawing at a higher reduction of area in a downstream-side drawing pass having a larger $\epsilon_C$.

More concretely, when $\epsilon_C$ of the wire rod is plotted on an abscissa and the reduction of area in the die for drawing such a wire rod is plotted on an ordinate, the pass schedule is favorable to be set so as to provide such a mountainous shape that a maximum reduction of area of not less than 20% is existent in a region $\epsilon_C$ of not less than 0.5 but less than 2.5.

As the die, use may be made of various shapes usually used. For example, a die having an approach angle of 8–15° and a bearing length corresponding to 0.3–0.8 times a hole diameter of the die can be used in case of drawing steel wire rods. As a material of the die, use may be made of sintered diamond, cheap super-hard alloy and the like.

The following examples are given in illustration of the invention and are not intended as limitations thereof.

A high-carbon steel material containing about 0.82% by weight of carbon and having a diameter of about 5.5 mm is subjected to a dry drawing to produce a steel wire rod having a diameter of about 1.72 mm. The steel wire rod is subjected to a patenting treatment and a brass plating treatment to obtain a brass-plated steel wire rod. Then, the brass-plated steel wire rod is subjected to a multiple slip type wet-drawing to manufacture a brass-plated steel filament having a diameter of 0.30 mm. In this case, a velocity of a steel filament after the passage through a final die at a steady drawing velocity is 800 m/min. And also, a super-hard alloy die having an approach angle of about 12° and a bearing length corresponding to about 0.5 times a hole diameter of the die is used as the die.

In the multiple slip type wet-drawing, there are provided seven conditions shown in Table 1 by properly combining two drawing apparatuses a and b having different capstan peripheral velocity ratios with five pass schedules A, B, C, D and E indicating a relation between cumulative drawing strain $\epsilon_C$ and reduction of area in die as a mountainous shape, during which the state of changing tension of wire rod just before a final die and quantity of final die worn per wire drawing quantity are measured. Moreover, the capstan peripheral velocity ratio used in the two drawing apparatuses is shown in Table 2, and details of five pass schedules and turning number of wire rod around the capstan are shown in Tables 3 to 7, respectively. In Table 2, the draft number indicates a number inherent to each drawing pass stage in the drawing apparatus by representing a final stage as [1] and adding number toward an upstream side in this order. And also, the capstan peripheral velocity ratio at a certain stage is a value calculated by (peripheral velocity of capstan at this stage—peripheral velocity of capstan located just at an upstream side of the stage)/(peripheral velocity of capstan located just at an upstream side of the stage)×100 (%).

Figure 2:
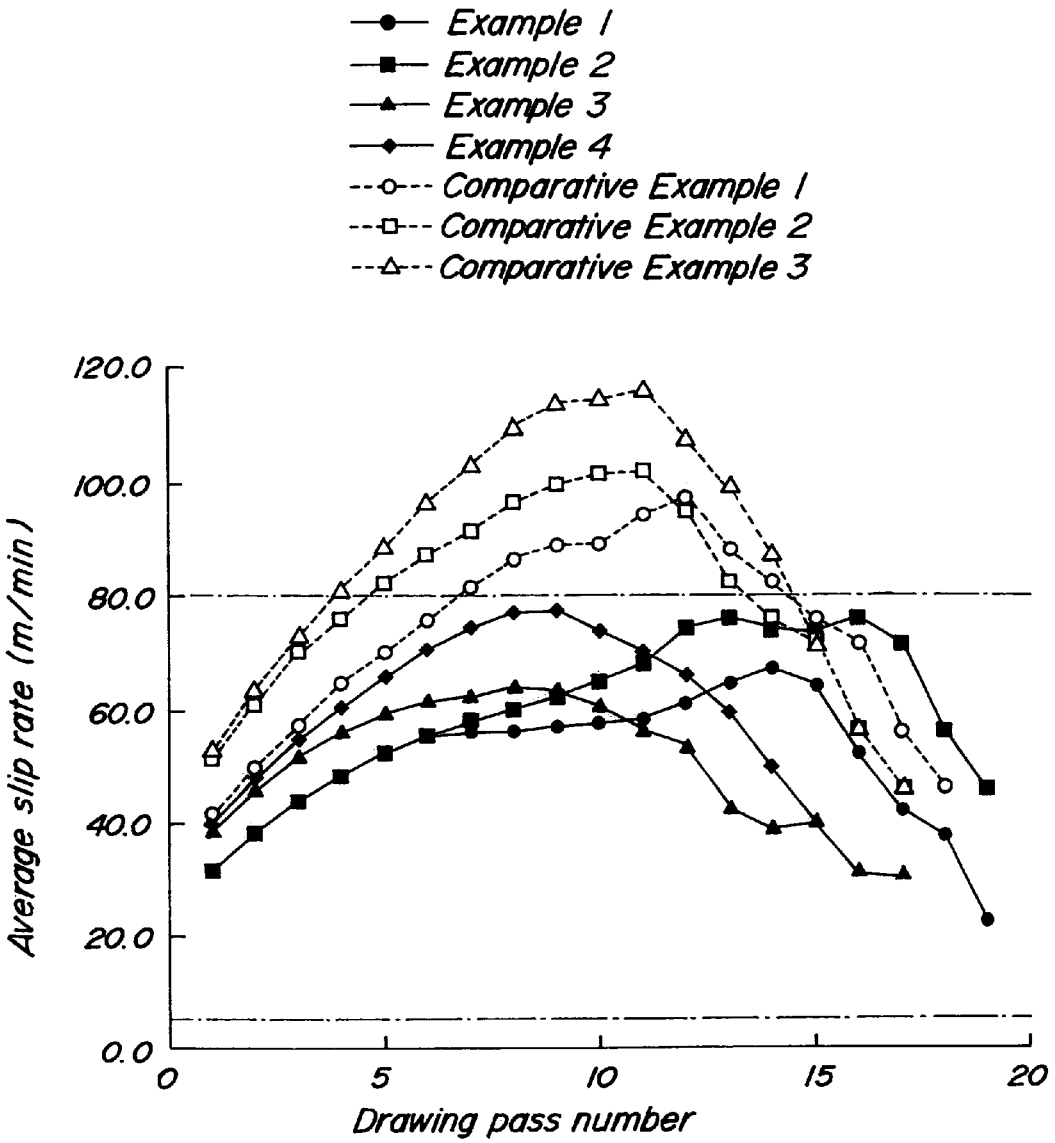
FIG. 2 is a graph showing an average slip rate of each drawing pass in Examples and Comparative Examples.
Figure 3:
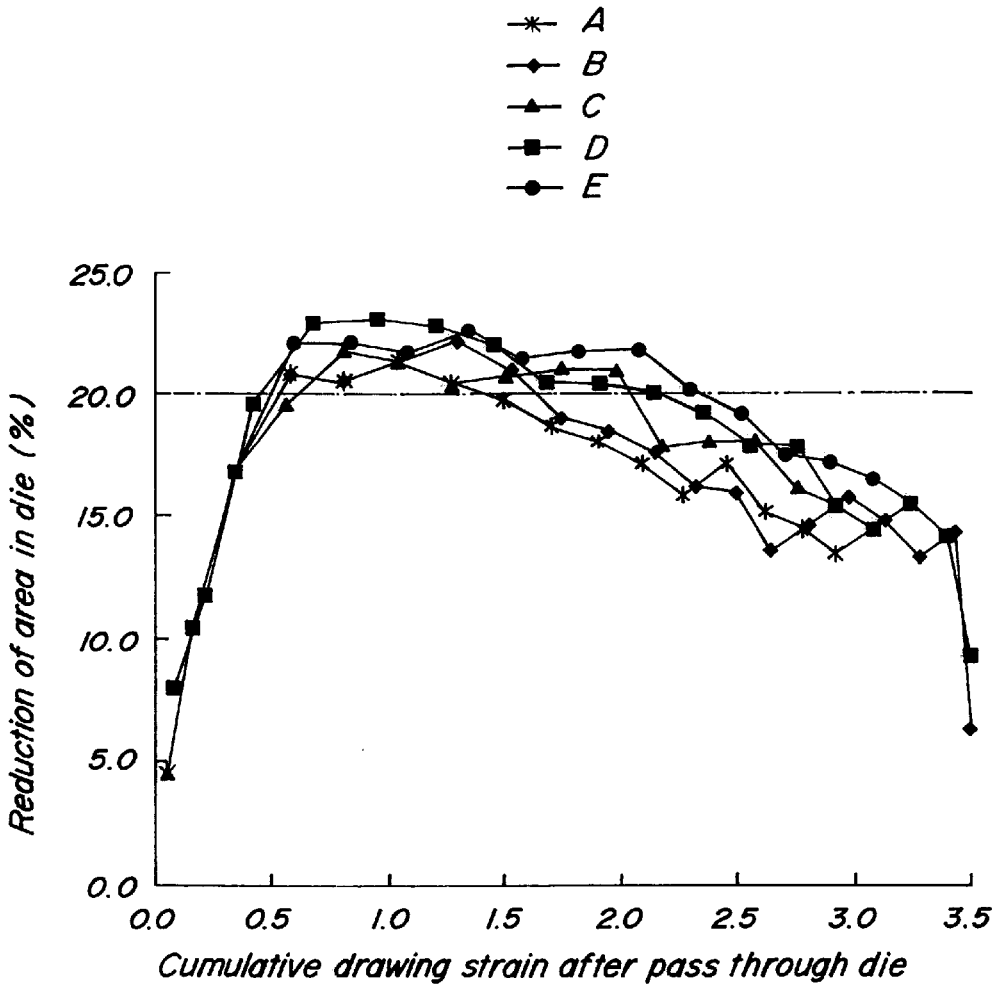
FIG. 3 is a graph showing a relation between cumulative drawing strain $\epsilon_c$ and reduction of area in die in pass schedule used in Examples and Comparative Examples.

Under each condition shown in Table 1, average slip rat in each drawing pass is shown in FIG. 2, and a relation between cumulative drawing strain $\epsilon_C$ and reduction of area in die at each pass schedule is shown in FIG. 3.

TABLE 1

| | Drawing apparatus | Pass schedule | Maximum average slip rate (m/min) | Minimum average slip rate (m/min) | Ratio of wire drawing through die having reduction of area of not more than 20% (%) |
|---|---|---|---|---|---|
| Example 1 | a | B | 67.1 | 22.8 | 34.1 |
| Example 2 | a | A | 76.2 | 31.8 | 26.7 |
| Example 3 | b | D | 64.2 | 30.4 | 49.1 |
| Example 4 | b | E | 77.6 | 30.4 | 56.0 |
| Comparative Example 1 | a | C | 97.3 | 41.5 | 40.6 |
| Comparative Example | a | D | 102.2 | 46.4 | 49.1 |
| Comparative Example 3 | a | E | 116.1 | 46.4 | 56.0 |

TABLE 2

| | Drawing apparatus a | | Drawing apparatus b | |
|---|---|---|---|---|
| Draft number | Capstan peripheral velocity ratio (%) | Peripheral velocity at final drawing velocity of 800 m/min (m/min) | Capstan peripheral velocity ratio (%) | Peripheral velocity at final drawing velocity of 800 m/min (m/min) |
| [1] | 3.5 | 800.0 | 5.5 | 800.0 |
| [2] | 12.0 | 772.0 | 13.5 | 756.0 |
| [3] | 12.0 | 679.4 | 13.5 | 653.9 |
| [4] | 12.0 | 597.8 | 13.5 | 565.7 |
| [5] | 12.0 | 526.1 | 13.5 | 489.3 |
| [6] | 12.0 | 463.0 | 13.5 | 423.2 |
| [7] | 12.0 | 407.4 | 14.5 | 366.1 |
| [8] | 14.0 | 358.5 | 14.5 | 313.0 |
| [9] | 14.0 | 308.3 | 14.5 | 267.6 |
| [10] | 14.0 | 265.2 | 14.5 | 228.8 |
| [11] | 14.0 | 228.0 | 14.5 | 195.6 |
| [12] | 14.0 | 196.1 | 14.5 | 167.3 |
| [13] | 14.0 | 168.7 | 14.5 | 143.0 |
| [14] | 14.0 | 145.0 | 14.5 | 122.3 |
| [15] | 14.0 | 124.7 | 14.5 | 104.6 |
| [16] | 14.5 | 107.3 | 14.5 | 89.4 |
| [17] | 14.5 | 91.7 | 14.5 | 76.4 |
| [18] | 14.5 | 78.4 | 14.5 | 65.3 |
| [19] | 14.5 | 67.1 | 14.5 | 55.9 |
| [20] | 14.5 | 57.3 | 14.5 | 47.8 |
| [21] | 14.5 | 49.0 | 14.5 | 40.8 |
| [22] | 14.5 | 41.9 | 14.5 | 34.9 |
| [23] | 14.5 | 35.8 | 14.5 | 29.9 |
| [24] | 14.5 | 30.6 | 14.5 | 25.5 |
| [25] | 14.5 | 26.2 | 14.5 | 21.8 |

TABLE 3

| | Pass schedule A | | | | | |
|---|---|---|---|---|---|---|
| Drawing pass number | Hole diameter of die (mm) | Reduction of area in die (%) | Cumulative drawing strain $\epsilon_c$ | Average velocity at final drawing velocity of 800 m/min (m/min) | Draft number used | Turning number of wire rod (turns) |
| 1 | 1.680 | 4.6 | 0.047 | 25.5 | [20] | 3.5 |
| 2 | 1.590 | 10.4 | 0.157 | 28.5 | [19] | 3.5 |
| 3 | 1.450 | 16.8 | 0.342 | 34.2 | [18] | 3.5 |
| 4 | 1.290 | 20.9 | 0.575 | 43.3 | [17] | 3.5 |
| 5 | 1.150 | 20.5 | 0.805 | 54.4 | [16] | 3.5 |
| 6 | 1.020 | 21.3 | 1.045 | 69.2 | [15] | 3.5 |
| 7 | 0.910 | 20.4 | 1.273 | 86.9 | [14] | 3.5 |
| 8 | 0.815 | 19.8 | 1.494 | 108.4 | [13] | 2.5 |

TABLE 3-continued

| | Pass schedule A | | | | | |
|---|---|---|---|---|---|---|
| Drawing pass number | Hole diameter of die (mm) | Reduction of area in die (%) | Cumulative drawing strain $\epsilon_c$ | Average velocity at final drawing velocity of 800 m/min (m/min) | Draft number used | Turning number of wire rod (turns) |
| 9 | 0.735 | 18.7 | 1.700 | 133.3 | [12] | 2.5 |
| 10 | 0.665 | 18.1 | 1.901 | 162.8 | [11] | 2.5 |
| 11 | 0.605 | 17.2 | 2.090 | 196.7 | [10] | 2.5 |
| 12 | 0.555 | 15.8 | 2.262 | 233.7 | [9] | 2.5 |
| 13 | 0.505 | 17.2 | 2.451 | 282.3 | [8] | 2.5 |
| 14 | 0.465 | 15.2 | 2.616 | 333.0 | [7] | 2.5 |
| 15 | 0.430 | 14.5 | 2.773 | 389.4 | [6] | 1.5 |
| 16 | 0.400 | 13.5 | 2.917 | 450.0 | [5] | 1.5 |
| 17 | 0.370 | 14.4 | 3.073 | 525.9 | [4] | 1.5 |
| 18 | 0.340 | 15.6 | 3.242 | 622.8 | [3] | 1.0 |
| 19 | 0.315 | 14.2 | 3.395 | 725.6 | [2] | 1.0 |
| 20 | 0.300 | 9.3 | 3.493 | 800.0 | [1] | 3.5 |

TABLE 4

| | Pass schedule B | | | | | |
|---|---|---|---|---|---|---|
| Drawing pass number | Hole diameter of die (mm) | Reduction of area in die (%) | Cumulative drawing strain $\epsilon_c$ | Average velocity at final drawing velocity of 800 m/min (m/min) | Draft number used | Turning number of wire rod (turns) |
| 1 | 1.680 | 4.6 | 0.047 | 25.5 | [20] | 3.5 |
| 2 | 1.590 | 10.4 | 0.157 | 28.5 | [19] | 3.5 |
| 3 | 1.450 | 16.8 | 0.342 | 34.2 | [18] | 3.5 |
| 4 | 1.290 | 20.9 | 0.575 | 43.3 | [17] | 3.5 |
| 5 | 1.150 | 20.5 | 0.805 | 54.4 | [16] | 3.5 |
| 6 | 1.020 | 21.3 | 1.045 | 69.2 | [15] | 3.5 |
| 7 | 0.900 | 22.1 | 1.295 | 88.9 | [14] | 3.5 |
| 8 | 0.800 | 21.0 | 1.531 | 112.5 | [13] | 2.5 |
| 9 | 0.720 | 19.0 | 1.742 | 138.9 | [12] | 2.5 |
| 10 | 0.650 | 18.5 | 1.946 | 170.4 | [11] | 2.5 |
| 11 | 0.590 | 17.6 | 2.140 | 206.8 | [10] | 2.5 |
| 12 | 0.540 | 16.2 | 2.317 | 246.9 | [9] | 2.5 |
| 13 | 0.495 | 16.0 | 2.491 | 293.8 | [8] | 2.5 |
| 14 | 0.460 | 13.6 | 2.638 | 340.3 | [7] | 2.5 |
| 15 | 0.425 | 14.6 | 2.796 | 398.6 | [6] | 1.5 |
| 16 | 0.390 | 15.8 | 2.968 | 473.4 | [5] | 1.5 |
| 17 | 0.360 | 14.8 | 3.128 | 555.6 | [4] | 1.5 |
| 18 | 0.335 | 13.4 | 3.272 | 641.6 | [3] | 1.0 |
| 19 | 0.310 | 14.4 | 3.427 | 749.2 | [2] | 1.0 |
| 20 | 0.300 | 6.3 | 3.493 | 800.0 | [1] | 3.5 |

TABLE 5

| | Pass schedule C | | | | | |
|---|---|---|---|---|---|---|
| Drawing pass number | Hole diameter of die (mm) | Reduction of area in die (%) | Cumulative drawing strain $\epsilon_c$ | Average velocity at final drawing velocity of 800 m/min (m/min) | Draft number used | Turning number of wire rod (turns) |
| 1 | 1.680 | 4.6 | 0.047 | 25.5 | [19] | 3.5 |
| 2 | 1.590 | 10.4 | 0.157 | 28.5 | [18] | 3.5 |
| 3 | 1.450 | 16.8 | 0.342 | 34.2 | [17] | 3.5 |
| 4 | 1.300 | 19.6 | 0.560 | 42.6 | [16] | 3.5 |
| 5 | 1.150 | 21.7 | 0.805 | 54.4 | [15] | 3.5 |
| 6 | 1.020 | 21.3 | 1.045 | 69.2 | [14] | 3.5 |
| 7 | 0.910 | 20.4 | 1.273 | 86.9 | [13] | 2.5 |
| 8 | 0.810 | 20.8 | 1.506 | 109.7 | [12] | 2.5 |
| 9 | 0.720 | 21.0 | 1.742 | 138.9 | [11] | 2.5 |

TABLE 5-continued

| Drawing pass number | Pass schedule C: Hole diameter of die (mm) | Reduction of area in die (%) | Cumulative drawing strain $\epsilon_c$ | Average velocity at final drawing velocity of 800 m/min (m/min) | Draft number used | Turning number of wire rod (turns) |
|---|---|---|---|---|---|---|
| 10 | 0.640 | 21.0 | 1.977 | 175.8 | [10] | 2.5 |
| 11 | 0.580 | 17.9 | 2.174 | 214.0 | [9] | 2.5 |
| 12 | 0.525 | 18.1 | 2.373 | 261.2 | [8] | 2.5 |
| 13 | 0.475 | 18.1 | 2.574 | 319.1 | [7] | 2.5 |
| 14 | 0.435 | 16.1 | 2.749 | 380.5 | [6] | 1.5 |
| 15 | 0.400 | 15.4 | 2.917 | 450.0 | [5] | 1.5 |
| 16 | 0.370 | 14.4 | 3.073 | 525.9 | [4] | 1.5 |
| 17 | 0.340 | 15.6 | 3.242 | 622.8 | [3] | 1.0 |
| 18 | 0.315 | 14.2 | 3.395 | 725.6 | [2] | 1.0 |
| 19 | 0.300 | 9.3 | 3.493 | 800.0 | [1] | 3.5 |

TABLE 6

| Drawing pass number | Pass schedule D: Hole diameter of die (mm) | Reduction of area in die (%) | Cumulative drawing strain $\epsilon_c$ | Average velocity at final drawing velocity of 800 m/min (m/min) | Draft number used | Turning number of wire rod (turns) |
|---|---|---|---|---|---|---|
| 1 | 1.650 | 8.0 | 0.083 | 26.4 | [18] | 3.5 |
| 2 | 1.550 | 11.8 | 0.208 | 30.0 | [17] | 3.5 |
| 3 | 1.390 | 19.6 | 0.426 | 37.3 | [16] | 3.5 |
| 4 | 1.220 | 23.0 | 0.687 | 48.4 | [15] | 3.5 |
| 5 | 1.070 | 23.1 | 0.949 | 69.2 | [14] | 3.5 |
| 6 | 0.940 | 22.8 | 1.208 | 81.5 | [13] | 2.5 |
| 7 | 0.830 | 22.0 | 1.457 | 104.5 | [12] | 2.5 |
| 8 | 0.740 | 20.5 | 1.687 | 131.5 | [11] | 2.5 |
| 9 | 0.660 | 20.5 | 1.916 | 165.3 | [10] | 2.5 |
| 10 | 0.590 | 20.1 | 2.140 | 206.3 | [9] | 2.5 |
| 11 | 0.530 | 19.3 | 2.354 | 256.3 | [8] | 2.5 |
| 12 | 0.480 | 18.0 | 2.553 | 312.5 | [7] | 2.5 |
| 13 | 0.435 | 17.9 | 2.749 | 380.5 | [6] | 1.5 |
| 14 | 0.400 | 15.4 | 2.917 | 450.0 | [5] | 1.5 |
| 15 | 0.370 | 14.4 | 3.073 | 525.9 | [4] | 1.5 |
| 16 | 0.340 | 15.6 | 3.242 | 622.8 | [3] | 1.0 |
| 17 | 0.315 | 14.2 | 3.395 | 725.6 | [2] | 1.0 |
| 18 | 0.300 | 9.3 | 3.493 | 800.0 | [1] | 3.5 |

TABLE 7

| Drawing pass number | Pass schedule E: Hole diameter of die (mm) | Reduction of area in die (%) | Cumulative drawing strain $\epsilon_c$ | Average velocity at final drawing velocity of 800 m/min (m/min) | Draft number used | Turning number of wire rod (turns) |
|---|---|---|---|---|---|---|
| 1 | 1.680 | 4.6 | 0.047 | 25.5 | [18] | 3.5 |
| 2 | 1.590 | 10.4 | 0.157 | 28.5 | [17] | 3.5 |
| 3 | 1.450 | 16.8 | 0.342 | 34.9 | [16] | 3.5 |
| 4 | 1.280 | 22.1 | 0.591 | 43.9 | [15] | 3.5 |
| 5 | 1.130 | 22.1 | 0.840 | 56.4 | [14] | 3.5 |
| 6 | 1.000 | 21.7 | 1.085 | 72.0 | [13] | 2.5 |
| 7 | 0.880 | 22.6 | 1.340 | 93.0 | [12] | 2.5 |
| 8 | 0.780 | 21.4 | 1.582 | 118.3 | [11] | 2.5 |
| 9 | 0.690 | 21.7 | 1.827 | 151.2 | [10] | 2.5 |
| 10 | 0.610 | 21.8 | 2.073 | 193.5 | [9] | 2.5 |
| 11 | 0.545 | 20.2 | 2.299 | 242.4 | [8] | 2.5 |
| 12 | 0.490 | 19.2 | 2.511 | 299.9 | [7] | 2.5 |
| 13 | 0.445 | 17.5 | 2.704 | 363.6 | [6] | 1.5 |

TABLE 7-continued

| Drawing pass number | Pass schedule E: Hole diameter of die (mm) | Reduction of area in die (%) | Cumulative drawing strain $\epsilon_c$ | Average velocity at final drawing velocity of 800 m/min (m/min) | Draft number used | Turning number of wire rod (turns) |
|---|---|---|---|---|---|---|
| 14 | 0.405 | 17.2 | 2.892 | 439.0 | [5] | 1.5 |
| 15 | 0.370 | 16.5 | 3.073 | 525.9 | [4] | 1.5 |
| 16 | 0.340 | 15.6 | 3.242 | 622.8 | [3] | 1.0 |
| 17 | 0.315 | 14.2 | 3.395 | 725.6 | [2] | 1.0 |
| 18 | 0.300 | 9.3 | 3.493 | 800.0 | [1] | 3.5 |

As seen from the results of the above tables, in the drawing under the conditions of Examples 1 to 4 that the average slip rate at each drawing pass other than the final stage is within a range of 5~80 m/in, the change of tension of the wire rod just before the final die is considerably less and the drawing can be conducted at an approximately constant tension. On the contrary, a spike-shaped change of tension of the wire rod is detected in the drawing under the conditions of Comparative Examples 1 to 3. And also, the quantity of the final die worn per the drawing quantity in Examples 1 to 4 is approximately ½ of those in Comparative Examples 1 to 3.

Figure 4:
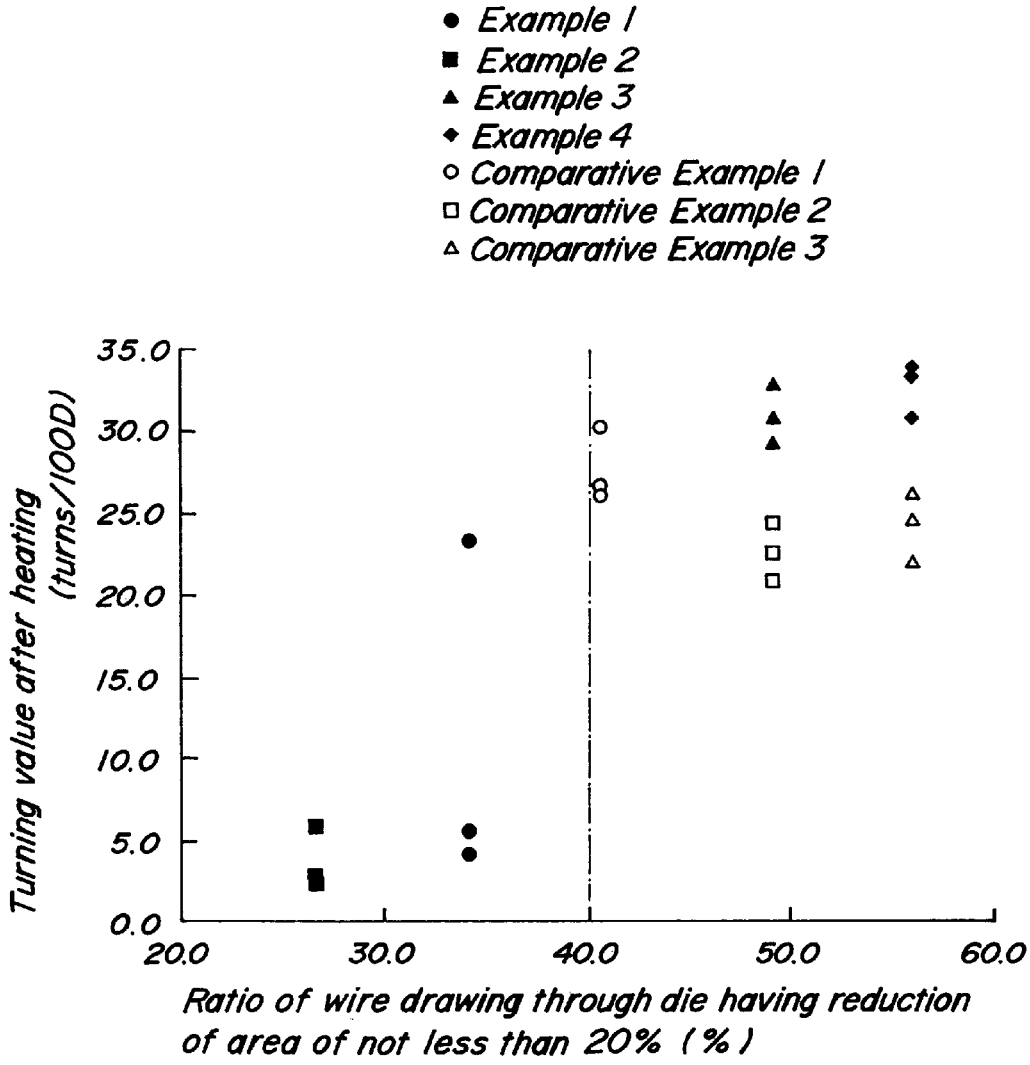
FIG. 4 is a graph showing a turning value after heating of steel filament in Examples and Comparative Examples.

With respect to the steel filament manufactured under the condition of each of Examples and Comparative Examples, the turning value after heating is measured under the following conditions to obtain results as shown in FIG. 4.

(1) Heating condition: The steel filament is heated at 145° C. for 40 minutes on the assumption of the heating for the vulcanization of rubber.

(2) Turning condition: The heated steel filament having a test length of 50 mm is turned at a rotating speed of about 60 turns/minute in its axial direction while applying tension of about 1.0 kg.

(3) Turning value: The turning value is a turning quantity applied per length corresponding to 100 times the diameter of the steel filament until the occurrence of surface crack or wire breakage of the steel filament. The larger the turning value, the better the turning property.

As seen from FIG. 4, the steel filaments manufactured when the wire drawing ratio in the die having a reduction of area of not less than 20% is not less than 40% indicate a considerably improved turning property after the heating as compared with the steel filaments manufactured when the wire drawing ratio in the die having a reduction of area of not less than 20% is less than 40%. In Comparative Examples 2 and 3, however, the wire drawing ratio in the die having a reduction of area of not less than 20% is larger than that in Comparative Example 1, but the maximum average slip rate is larger than that of Comparative Example 1, so that the turning property of the steel filament after the heating is poorer than that of Comparative Example 1. On the contrary, the steel filaments manufactured in Examples 3 and 4 under conditions that the average slip rate satisfies the requirement of the invention and he wire drawing ratio in the die having a reduction of area of not less than 20% is not less than 40% indicate the turning property after the heating more excellent than that of Comparative Example 1.

As mentioned above, according to the multiple slip type wet-drawing process of the invention, when the difference between the peripheral velocity of the capstan and the drawing velocity of the wire rod is set to an adequate level, discontinuous change of wire velocity and tension in the drawing is controlled and the problems such as premature wearing the die, wire breakage, damage of wire rod and the like can be solved and also wire filaments having a high quality can be manufactured efficiently.

Furthermore, in the multiple slip type wet-drawing process of the invention, when the wire drawing corresponding to not less than 40% of the total drawing strain is carried out in the die having the reduction of area of not less than 20%, it is possible to manufacture wire filaments having a good ductility and hardly degrading the ductility even by heat aging. Therefore, the invention is particularly suitable for high-speed drawing of, for example, high-strength steel filaments. And also, the resulting steel filaments can preferably be used as a reinforcement for rubber articles requiring a high durability and the like.

What is claimed is:

1. A multiple slip type wet-drawing process for making a wire filament comprising drawing a wire rod through successive plural drawing pass stages each comprised of a die and a capstan which draws the wire rod through the die;

wherein an average slip rate $S_i$ in each drawing pass stage other than a final stage is defined by the following equation:

$$S_i = Vc_i - Vw_i$$

wherein $Vc_i$ is a peripheral velocity of a capstan at each stage and $Vw_i$ is an average velocity of a wire rod passed through a die at each stage, is set to within a range of from 5 to 80 m/min.

2. The process according to claim 1, wherein the average slip rate $S_i$ is set to not more than 50 m/min.

3. The process according to claim 1, wherein wire drawing corresponding to not less than 40% of total wire drawing strain is carried out by using a die having a reduction of area of not less than 20%.

4. The process according to claim 3, wherein wire drawing using the die having the reduction of area of not less than 20% is carried out in a drawing pass drawing a wire rod having a cumulative drawing strain from an initial stage of not less than 0.5 but less than 2.5.

* * * * *